US008235386B1

(12) United States Patent
Taig et al.

(10) Patent No.: US 8,235,386 B1
(45) Date of Patent: Aug. 7, 2012

(54) SHEET PROCESSING

(75) Inventors: Elad Taig, Lexington, MA (US); Avichay Mor-Yosef, Jerusalem (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/017,479

(22) Filed: Jan. 31, 2011

(51) Int. Cl.
*B65H 5/02* (2006.01)

(52) U.S. Cl. ..... 271/272; 271/275; 271/314

(58) Field of Classification Search ..... 271/272, 271/273, 275, 277, 314
See application file for complete search history.

(56) References Cited

U.S. PATENT DOCUMENTS

| | | | | |
|---|---|---|---|---|
| 7,113,717 | B2 | 9/2006 | Bott et al. | |
| 7,151,248 | B2 | 12/2006 | Harush et al. | |
| 7,623,803 | B2 | 11/2009 | Carolan et al. | |
| 2005/0095035 | A1 * | 5/2005 | Vejtasa et al. | 399/168 |
| 2005/0129426 | A1 * | 6/2005 | Tsunemi et al. | 399/159 |
| 2008/0084023 | A1 | 4/2008 | Taig et al. | |
| 2008/0157465 | A1 | 7/2008 | Matsumoto | |
| 2008/0231220 | A1 | 9/2008 | Tsujimoto et al. | |
| 2008/0264283 | A1 | 10/2008 | Taig et al. | |
| 2010/0199870 | A1 | 8/2010 | Taig et al. | |

FOREIGN PATENT DOCUMENTS

| | | | |
|---|---|---|---|
| WO | 2008041986 | A1 | 4/2008 |
| WO | 2010030292 | A1 | 3/2010 |

* cited by examiner

*Primary Examiner* — David H Bollinger

(57) ABSTRACT

A sheet processing system, comprising a number of drums for processing sheets, one of the drums comprising a seam area and a non-seam area, a gap between the drums, an actuator for displacing one of the drums for setting the gap, a manager, comprising a memory and a processor, that regulates the actuator current when the non-seam area passes through a nip so as to maintain a nip pressure, and signals the actuator to adjust the gap according to a predetermined gap setpoint profile when the seam area passes through the nip.

14 Claims, 8 Drawing Sheets

SHEET PROCESSING

BACKGROUND

In sheet processing systems it is advantageous to control pressure exerted on sheets. Many sheet processing systems use drums to process the sheets. In such systems, it is advantageous to be able to control a pressure exerted by the drums on the sheets.

BRIEF DESCRIPTION OF THE DRAWINGS

The accompanying drawings illustrate various examples of the principles described herein and are a part of the specification. The illustrated figures are merely examples and do not limit the scope of the claims.

Throughout the drawings, identical reference numbers designate similar, but not necessarily identical, elements.

DETAILED DESCRIPTION

In the following description as well as in the accompanying figures, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one example, but not necessarily in other examples. The various instances of the phrase "in one example" or similar phrases in various places in the specification are not necessarily all referring to the same example.

As used in the present specification and in the appended claims, the term "sheet processing" may broadly comprise the acts of printing, advancing sheets, modifying sheets, re-arranging sheets in any way or any combination thereof.

Figure 1:
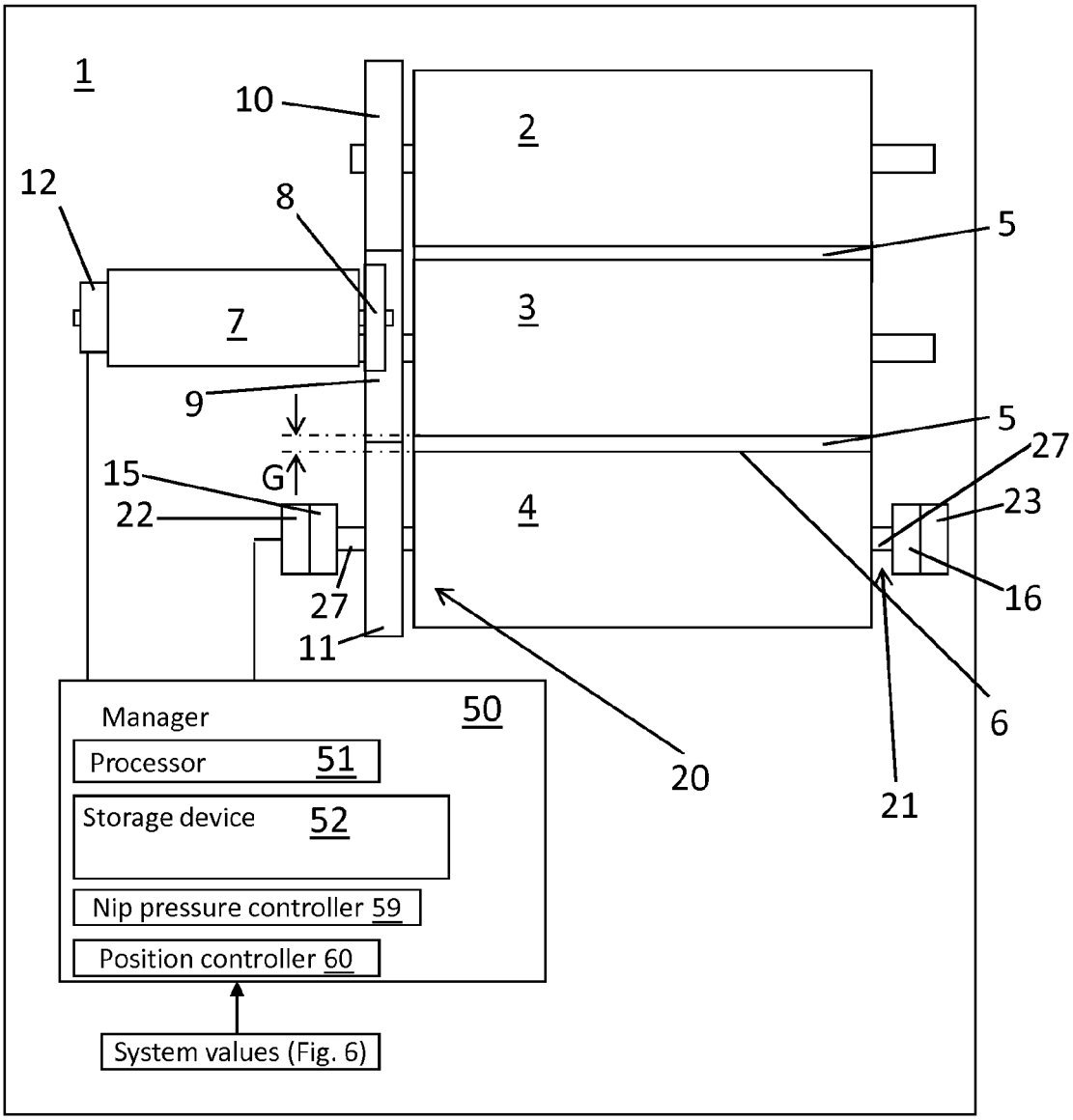
FIG. 1 is a diagram of one illustrative example of a sheet processing system, according to one example of principles described herein.

Turning now to the figures, FIG. 1 shows a sheet processing system (1) comprising a number of drums (2, 3, 4). In one example, the sheet processing system (1) may comprise an electrophotographic printer. In yet a further example, the sheet processing system (1) may comprise a liquid electrophotographic digital press. The skilled person, however, will understand and appreciate that system (1) may comprise still other various types of a sheet processing system, for example another type of printer or press. The sheets may comprise print media made of, for example, paper, vinyl, plastics sheet, cotton, cellulose and/or other materials.

In one example, the number of drums (2, 3, and 4) may comprise a developer drum (2), a transfer drum (3), and an impression drum (4) as known from an electrophotographic printer. The transfer drum (3) may be arranged to transfer an image from the developer drum (2) to a sheet that is mounted on the impression drum (4). In the shown example, an interchangeable blanket (5) is mounted on the transfer drum (3) to aid in transferring the image. In one example, the blanket (5) may be changed after a certain number of toner images have been transferred by the blanket (5) to respective sheets.

In use, as sheets advance through a nip (6) positioned between the transfer drum (3) and the impression drum (4), pressure exerted by the transfer drum (3) on the sheet may be determined by the pressure applied between the transfer drum (3) and the impression drum (4). This pressure is referred to as nip pressure. In one example, the nip pressure is maintained near a certain predetermined value during the transfer of the image from the transfer drum (3), or alternatively the blanket (5), to the sheet. Temperature changes in the materials of the sheets, blankets (5), or surfaces of the number of drums (2, 3, and 4) can affect the nip pressure. Also, irregularities in the sheets, blankets (5), or surfaces of the number of drums (2, 3, and 4) can affect the nip pressure. Further, other nip pressure affecting aspects may include, but may not be necessarily limited to, transients, manufacturing tolerances, system transients and more. Moreover, in certain examples at least one of the number of drums (2, 3, 4) may comprise a seam. These seams may also affect the nip pressure in a similar way.

The durability of the number of drums (2, 3, and 4) may be influenced by changes in nip pressure. In a printer or press the nip pressure may influence the quality of a printed image for each sheet. Therefore, to better control the durability and/or image quality, the nip pressure may be controlled.

In this description, the words "gap" and "nip" are used. The gap forms the distance between the drums (3, 4) without a blanket (5) or sheet, while a nip (6) may be defined as the passage through which the sheets advance. In an example, a passage may be created by the elasticity of the blanket (5) to allow the sheets to pass through. When no sheet extends in the nip, the space between the drums (2, 3, 4) is occupied by the blanket (5).

In one example, the system may comprise at least one drive (7) for driving at least one of the number of drums (2, 3, 4). The drive (7) may comprise a rotational motor, for example an electromotor. In the example shown in FIG. 1, the drive (7) drives the transfer drum (3). The drive (7) may comprise a drive gear (8) for engaging a transfer drum gear (9) of the transfer drum (3). The transfer drum gear (9) may engage a developer drum gear (10) and an impression drum gear (11) for rotating the developer drum (2) and the impression drum (4), respectively. In other examples, the number of drums (2, 3, and 4) may be driven by separate drives. The drive rotations may be transmitted by any number of gears or by other mechanisms than gears. For example the rotation of the number of drums (2, 3, 4) with respect to each other may be transmitted by at least one of gears, belts, bars, electric controls, etc.

In one example, an encoder (12) is provided for determining the rotational position of the sheet processing drums (3 and 4). In the example shown in FIG. 1, the encoder (12) is connected to the drive (7). As will be understood, in the shown example, the rotational position of each of the connected drums (2, 3, 4) can be determined by the rotational position of the drive (7). Hence, in the shown example, the rotational position of the impression drum (4) and the transfer drum (3) can be read from the encoder (12) of the drive (7). In other examples, the rotational position of the drums (2, 3, 4) may determined by other mechanisms, for example using optical, magnetic, or other types of sensors, or switches.

Figure 2:
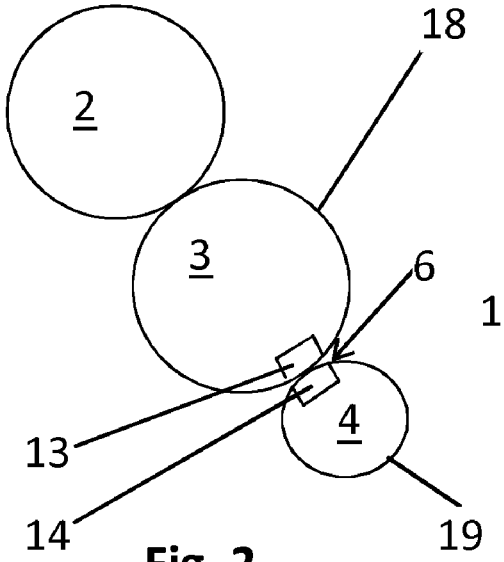
FIG. 2 is a diagrammatic cross sectional side view of a sheet processing system with a set of drums in a first orientation, according to one example of principles described herein.
Figure 3:
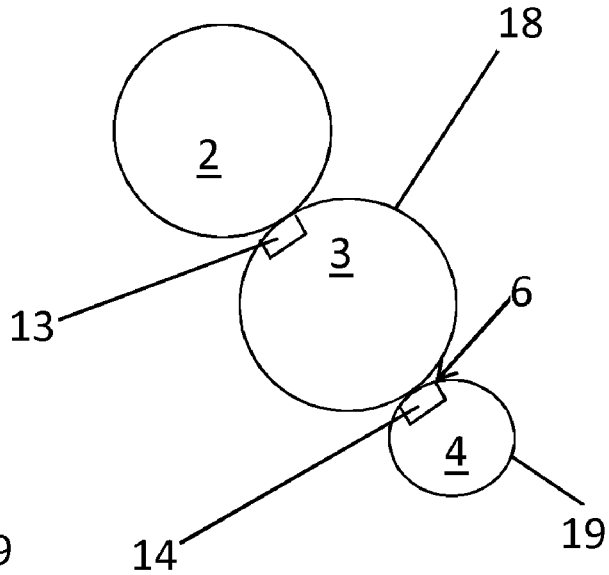
FIG. 3 is a diagrammatic cross sectional side view of a sheet processing system of FIG. 2 with a set of drums in a second orientation, according to one example of principles described herein.

FIGS. 2 and 3 each show a different rotational position of the number of drums (2, 3, 4). In the examples shown in FIGS. 2 and 3, the transfer drum (3) may comprise a first seam area (13) and a non-seam area (18). In one example, the seam area (13) may comprise a gripper arrangement. The gripper arrangement is arranged for gripping and mounting the blanket (5). The non-seam area (18) is a print area. In a mounted condition, the blanket (5) extends along the non-seam area (18). The non-seam area (18) may be used for transferring an image.

In an example, the impression drum (4) may comprise a second seam area (14) and a second non-seam area (19). The second seam area (19) may comprise a gripper arrangement for gripping and mounting the sheet. In a mounted condition, the sheet extends along the second non-seam area (19). In the shown example, the diameter of the impression drum (4) is half of the diameter of the transfer drum (3). When the impression drum (4) and the transfer drum (3) rotate with respect to each other, the second seam area (14) of the impression drum (4) passes the transfer drum (3) in two different rotational positions of the transfer drum (3). In a first rotational position of the transfer drum (3), the first seam (13) and the second seam (14) face each other, as illustrated by FIG. 2. In a second rotational position the second seam (14) faces the transfer drum (3), and the first seam (13) faces towards the opposite side, for example approximately towards the developer drum (2), as illustrated by FIG. 3. The nip pressure between the transfer drum (3) and the impression drum (4) may change each time one of the first and second seam areas (13, 14) passes through the nip (6). In the example shown in FIGS. 2 and 3, a seam area (13 and 14) passes two times through the nip (6) for each transfer drum rotation.

In addition to a gripper arrangement, the seam areas (13, 14) may comprise any disruption in the diameter of the respective drum (3, 4) across a substantial part of the surface of the drum (3, 4). In other examples, at least one seam area (13, 14) may comprise an edge of a plate or sheet, or a longitudinal notch or indent that is present in the surface of the drum (3, 4). The seam area (13, 14) may extend substantially parallel to the axis of rotation of the respective drum (3, 4).

If no measurements are provided, the seam areas (13, 14) would cause a change in nip pressure every time when passing through the nip (6). It may be predicted when a seam area (13, 14) passes through the nip based on the rotational position of the respective drum (3, 4), for example through encoder (12).

In certain examples, only the transfer drum (3) may comprise a seam area (13). In another example, only the impression drum (4) may comprise a seam area (14). In further examples, the transfer drum (3) and/or the impression drum (4) have one, two, three, four or more seam areas.

Turning back to FIG. 1, at least one of the drums (3, 4) is provided with at least one displacement actuator (15, 16) for displacing the respective drum (3, 4) with respect to the opposite drum (4, 3). The actuator (15, 16) is arranged to displace the drum (4) with respect to the opposite drum (3) so as to adjust the gap (G) and to regulate a nip pressure. In the shown example, the impression drum (4) is provided with a first actuators (15) at a first end (20) of the drum (4) and a second actuator (16) at an opposite end (21) of the drum (4), thereby allowing for both parallel and non-parallel displacement of the impression drum (4) with respect to the transfer drum (3).

Figure 4:
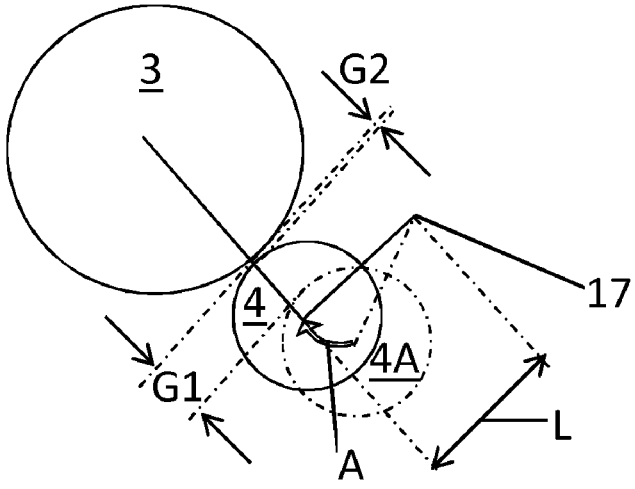
FIG. 4 is a diagrammatic cross sectional side view of a sheet processing system showing a gap between two drums being adjusted according to one example of principles described herein.

FIG. 4 schematically depicts an example of a displacement of the impression drum (4), as caused by an actuator (15). In the example shown in FIG. 4, the actuator (15) is arranged to rotate around a rotation center (17), in order to displace the impression drum (4) in an angular direction (A). Additionally, the impression drum (4) is displaced so as to change from a first gap (G1) to a second gap (G2).

As shown in FIG. 1, the system (1) may further comprise an encoder (22, 23) for determining the angular position of the actuator (15, 16). The system (1) may comprise a first encoder (22) for the first actuator (15) and a second encoder (23) for the second actuator (16). The encoder (22, 23) may be used to determine and regulate the angular position of the respective actuator (15, 16), wherein the angular position corresponds with the gap (G). Consequently, the encoder (22) may be used to determine and regulate the gap size.

Figure 5:
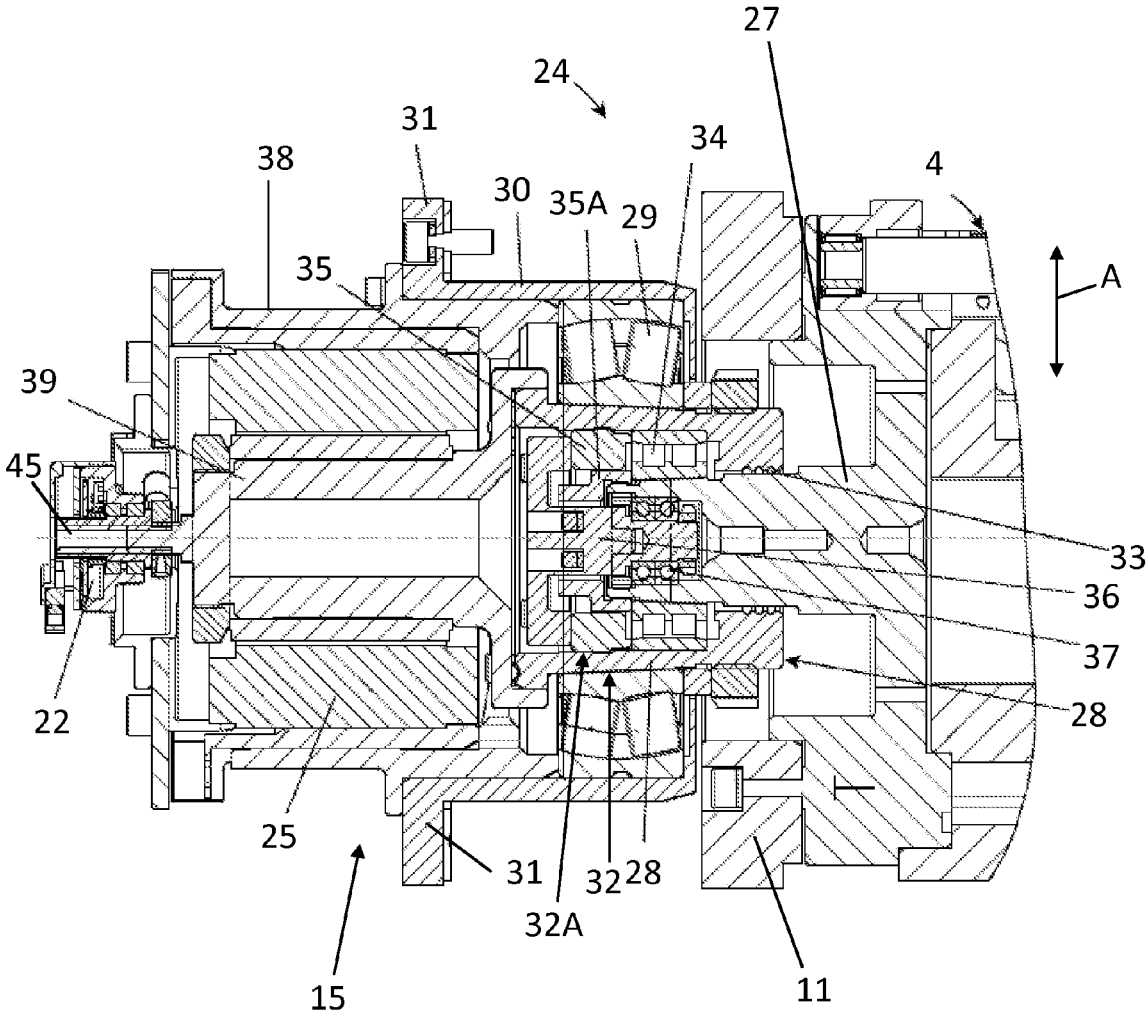
FIG. 5 is a cross sectional front view of an end portion of a drum and an actuator according to one example of principles described herein.

FIG. 5 illustrates a detailed view of an example of one of the actuators (15) and an end (20) of the drum (4). It is noted that the actuator (16) at the opposite end (21) of the drum (4) may be similar in configuration. In FIG. 5 a portion of the drum (4), the actuator (15) and an encoder (22) are shown. The actuator (15) may comprise a motor (25), for example an electromotor, and a coupling mechanism (24). The shown actuator (15) may comprise a relatively rigid construction and a relatively rigid motor such as a frameless motor (25).

The actuator (15) is adapted to displace the drum (4) relative to the opposite drum (3) to set a gap (G) and a corresponding nip pressure. The actuator (15) may comprise a coupling assembly (24). In the example shown in FIG. 5, the coupling assembly (24) may comprise an eccentric component (28), which is mounted in a self-aligning bearing (29). The self-aligning bearing (29) and the eccentric component (28) are mounted within a cylindrical housing (30). The components of the coupling assembly (24) are rigidly connected with respect to each other. The cylindrical housing (30) is rigidly connected to a frame (not shown) of the sheet processing system (1) through a flange (31). The eccentric component (28) may comprise a cylindrical surface (32) which is concentrically mounted in the self-aligning bearing (29). The eccentric component (28) may comprise an eccentrically arranged opening (33) for receiving the shaft (27) of the impression drum (4). Rotation of the eccentric component (28) displaces the eccentrically arranged opening (33) and the impression drum in the angular direction (A). A further inner bearing (34) may be provided for enabling the impression drum's rotation and maintain extra stiffness in the connection between the eccentric component (28) and the shaft (27). The inner bearing (34) may be held in axial position by a lock-ring (35) that is pressed in position.

The inner bearing (34) is mounted eccentrically in the eccentric component (28), through the eccentrically arranged opening (33). By rotating the eccentric component (32) with the motor (25), the drum (4) will be displaced in a direction (A), towards or away from the opposite drum (3), for example in an angular direction (A), as schematically depicted by FIG. 4. Consequently, the gap size (G) and nip pressure can be varied with the actuator (15).

In one example, the eccentric component (28) may comprise a ring shaped element, a cylinder, or an eccentric bearing. In other examples, other eccentrically mounted components may be used in order to displace the drum (4). The eccentric component (28) may have an eccentric opening or an eccentric outer surface, for eccentrically mounting a shaft portion of the respective roller.

In an example, the motor (25) may comprise a frameless motor. The motor (25) may comprise a stator housing (38). The stator housing (38) is connected to the cylindrical housing (30), and is in that way connected to the frame of the system (1). The motor (25) may further comprise a rotor (39). The rotor (39) rigidly connects to the eccentric component (28). The rotor (39) is fitted within a non-eccentric inner surface (32A) of the eccentric component (28). The drum (4) may be axially connected through a connection portion (36) and/or further bolts and/or screws. The rotor (39) freely rotates with respect to the shaft (27) and the drum (4) through further bearings (34). A further lock ring (35A) may clamp the further bearings (34). Rotation of the rotor (39) causes the drum (4) to displace in an angular direction (A), independent of the rotation of the drum shaft (27). In an example, rotation of the drum (4) may be effected by the drive (7), through the drum gear (11).

The encoder (22) is connected to an outgoing axis (45) of the motor (25). The encoder (22) measures the rotation position of the motor (25) (or the rotor 39) which corresponds to the rotation position of the eccentric component (28), which in turn corresponds to the size of the gap (G).

Turning back to FIG. 1, the system (1) may comprise a manager (50). The manager (50) may comprise a processing circuit (51) and a storage device (52). The storage device (52) is connected to the processing circuit (51). The storage device (52) may comprise a non-volatile memory. The storage device (52) may store predetermined algorithms, such as gain scheduling algorithms, and/or calibration values, such as blanket and sheet calibration values, and/or gap setting profiles. In an example, the manager (50) may comprise or be part of a printer controller.

Figure 6:
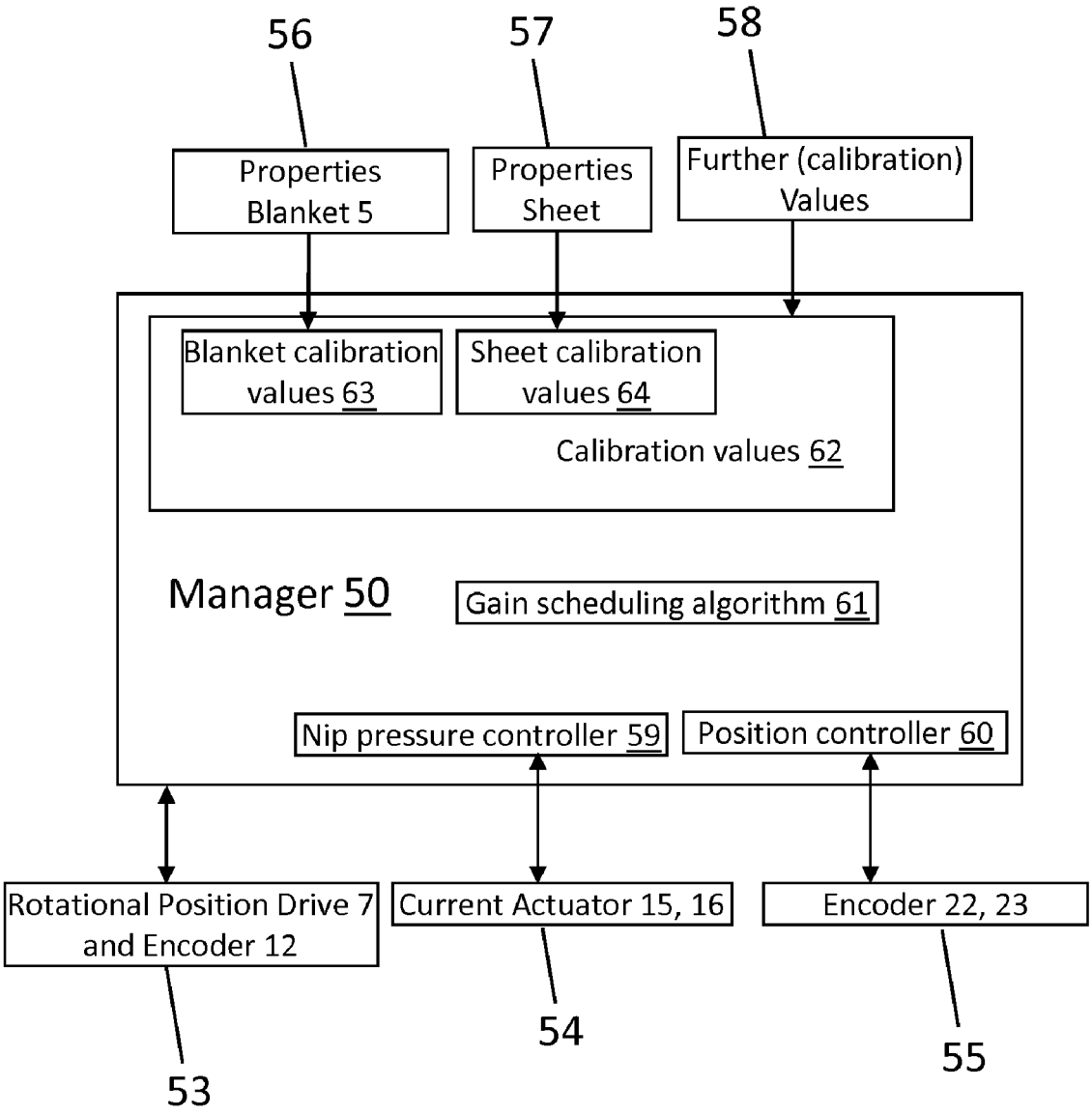
FIG. 6 is a block diagram of a manager data input and output according to one example of principles described herein.

As illustrated in FIG. 1 the manager (50) is connected to the encoder (12) of the drum drive (7), also by block 53 of FIG. 6. The manager (50) reads and controls the rotational position of the drive (7), and of the respective drums (2, 3, 4), through the drive encoder (12). Hence, the manager (50) determines the rotational position of the seam area (13, 14) and the non-seam area (18, 19) of the respective drums (3, 4).

In a further example, the manager (50) is connected to the actuator (15, 16). The manager (50) sends and receives signals from the actuator (15, 16), as indicated by block 54 of FIG. 6. The manager (50) reads and regulates the actuator current. In one example, the actuator (15, 16) may comprise a motor (25). The torque (T) of the motor (25) is a function of the actuator current (I), multiplied by a certain motor parameter (Kt). In turn, the torque is a function of the nip pressure (NP). The nip pressure is defined by the force (F) on the respective drum (4), divided by the area (A) of the force. In one example, the nip pressure (NP) can be calculated from the torque by using a constant (L) that describes the geometry or eccentricity of the eccentric component, for example the eccentric component (28). In one example, L is defined by the distance between the center of rotation (17) of the actuator (15) and the center of the impression drum (4), as can be seen from FIG. 4. Hence, the manager (50) may store the following functions for deriving the nip pressure from the actuator current.

$$T=Kt*I$$

$$F=T/L$$

$$NP=F/A$$

Hence, nip pressure control may comprise actuator current regulation. The manager (50) may comprise a nip pressure controller (59) that regulates the actuator current. The nip pressure controller (59) may maintain the nip pressure at, or near to, a certain desired value. In an example, such value may correspond to a nominal printing pressure. The nip pressure controller (59) regulates the actuator current when the non-seam area (18, 19) passes through the nip (6). The nip pressure controller (59) is arranged to correct current variations to compensate for corresponding pressure variations, for example pressure changes that would otherwise occur due to temperature changes in the materials of the sheets, blankets (5), or surfaces of the respective drums (2, 3, 4); irregularities in the sheets, blankets (5), or surfaces of the respective drums (2, 3, 4); system transients, manufacturing tolerances, and more. The pressure changes that occur when the non-seam area (18, 19) passes through the nip can be evened out by maintaining the current at the predetermined value. By sensing the drive current and real-time correction, the nip pressure may be maintained within a certain range along the length of a transferred image. In an example, the range of deviation from the nominal pressure is 7.5% or less of the nominal pressure.

In an example, the nip pressure controller (59) may receive direct feedback from a rigid actuator assembly. For example, the assembly as explained by FIG. 5 may provide for such a rigid actuator (15, 16). The nip pressure controller (59), in combination with a relatively rigid actuator (15, 16), may allow for approximately real time and relatively high bandwidth correction of the nip pressure.

In an example, the nip pressure controller (59) does not actively regulate the nip pressure when the seam area (13, 14) passes through the nip 6. The timing and position of the respective seam and non-seam areas (13, 14, 18, 19) with respect to the nip (6) are determined by the manager (50). For example, the manager (50) may switch off the nip pressure controller (59) when a respective seam area (13, 14) passes through the nip (6).

The manager (50) is connected to the actuator (15, 16) for sending and receiving values corresponding to the gap (G). In an example, the manager (50) may be connected to the encoder (22, 23) for sending and receiving the rotational position of the actuator (15, 16). The manager may comprise a position controller (60) for setting the gap (G). The gap (G) corresponds to a displacement position of the respective actuator (15, 16). In an example, the gap (G) corresponds to a rotation position of the encoder (22, 23). The position controller (60) is arranged to adjust the gap (G) when a respective seam area (13, 14) passes through the nip (6). By adjusting the gap (G) when the seam area (13, 14) passes through the nip (6) relatively large nip pressure disruptions may be prevented. In the seam area (13, 14) the gap (G) is adjusted according to a predetermined gap setpoint profile, as will be explained with reference to FIG. 7. The manager signals the position controller (60) when the seam area (13, 14) passes through the nip (6).

In an example, the manager (50) may comprise a gain scheduling algorithm (61) for smooth switching between nip pressure control and position control. When the seam area (18, 19) passes through the nip (6), the gap (G) may be controlled by the nip pressure controller (59), using current regulation. When the non-seam area (18, 19) passes through the nip (6), the gap (G) may be controlled by the position controller (60), using gap adjustment according to the predetermined gap setpoint profile. The manager (50) manages the nip pressure controller (59) and the position controller (60). The manager (50) switches between the nip pressure controller (59) and the position controller (60).

Before and during processing of the sheets, the manager (50) calculates calibration values (62). The calibration values (62) may be used to set an initial gap (G), i.e. a nominal pressure gap (G), during processing. The calibration values (62) also determine the gap setpoint profile (FIG. 7).

Periodically, a new blanket (5) may be mounted on the transfer drum (3), after which the system (1) may need to be calibrated. Therefore, in an example, the manager (50) receives and/or calculates blanket calibration values (63). The blanket calibration values (63) correspond to properties (56) of the blanket (5). Such properties may include thickness and elasticity. For example, a new blanket may change a ratio between the current or torque and the gap (G). The blanket calibration value (63) may be used to set the initial gap (G) at the start of the non-seam area (18, 19) passing through the nip (6). Likewise, the calibration values (62) may comprise sheet calibration values (64), be based on sheet properties (57), such as thickness and/or elasticity. Also for different sheets having different properties different correlation between gap (G) and motor current may apply. Depending on a print job, the properties of a sheet passing through the nip (6) may change with respect to a previous sheet passing through the nip (6). Using the sheet calibration values (64), a different initial gap (G) may be set by the position controller (60), corresponding to different sheet properties. The sheet properties (57) and/or calibration values (64) can be entered and/or calibrated before a print job. Any of the calibration values (62) may be re-calculated or adjusted at any time if needed, for example during sheet processing.

It will be understood that also further calibration values (58) can be used by the manager (50), for example relating to a particular print job, drum, etc. For example, a protective sheet or layer may be provided for the impression drum (4). Such protective sheet may be arranged onto the drum (4), and in use under the sheets for processing. In an example, the protective sheet is used to prevent that certain inks, toners or fluids reach the impression drum (4). The protective sheet may introduce further calibration values (62) as indicated by block 58.

Figure 7:
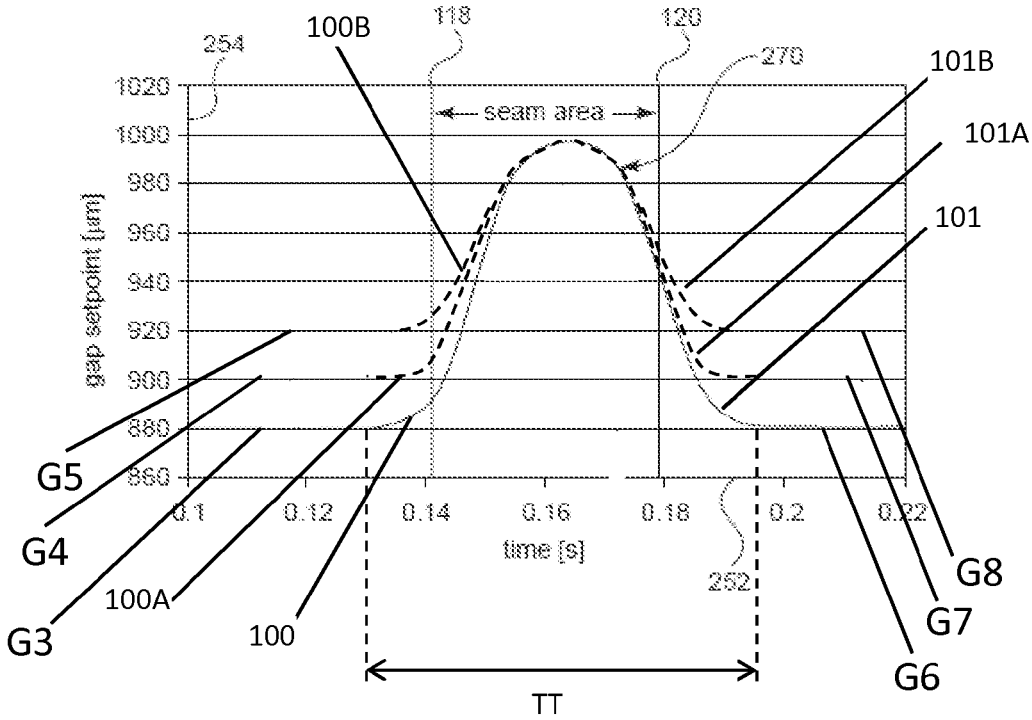
FIG. 7 is a plot containing multiple examples of gap setpoint profiles, corresponding to multiple possible first and second sheet properties according to the principles described herein.

FIG. 7 illustrates examples of gap setpoint profiles (270). The gap setpoint profile is a function of the width of the gap (G), referred to as "gap setpoint" in FIG. 7. The gap setpoint profile is a function of the displacement of the drums (3, 4) with respect to each other. FIG. 7 plots the gap size (G) ("gap setpoint") in μm, on the vertical axis (254), against time in seconds, on the horizontal axis (252).

The impression drum may lift from a first gap (G) and land at a different gap (G), for example because the previous sheet is different from the next sheet. Hence the profile (270) may be different depending on the previous and the next sheet. In an example, the gap setpoint profile (270) may vary depending on the sheet properties of the respective sheet. For example a first portion (100, 100A, 100B) of the profile (270) may correspond to a first sheet having first properties. The first sheet may be a previous sheet that was the last processed sheet. The incoming gap (G3, G4, G5) depends on the properties of the previous sheet, for example the thickness thereof. One example profile (100) may comprise an incoming gap (G3) of 880 μm. A second example profile (100A) may comprise an incoming gap (G4) of 900 μm. A third example (100B) may comprise an incoming gap (G5) of 920 μm.

The gap is temporarily increased at the seam-area (13, 14). In the shown example, the displacement time interval TT starts at approximately 0.135 seconds and ends at approximately 0.19 seconds. In the shown example, the profile (270) reaches a maximum gap (G) of approximately 998 μm. In other examples, different maximum gaps (G) may be applied. In the shown example, the actual seam area (13, 14) may start at approximately 0.142 seconds, as indicated by line 118, and end at approximately 0.178 seconds, as indicated by line 120. The impression drum (3) may lift and land approximately before and after, respectively, the seam area (13, 14). Thereby a release of elastic energy or a bumping action due to an edge of the seam area (13, 14) may be prevented. It may also cause a gradual building of pressure on the blanket (5), help improve the print quality at the beginning of the image, and prolong blanket life.

The gap setpoint profile (270) may further comprise a second portion (101, 101A, 101B) for setting an initial gap (G6, G7, G8), corresponding to a second sheet that is to be processed. The initial gap (G6, G7, G8) for the second sheet may be different from the gap (G3, G4, G5) of the first, previous sheet. For example a first portion (100A) of the profile (270) may start off at a gap (G4) of approximately 900 μm, after having printed a first paper sheet having a first thickness. Then, a second portion (101B) of the profile may end at a gap (G8) of approximately 920 μm, which is the initial gap (G8) for processing the second sheet, the second sheet having a second thickness greater than the first thickness.

In an example, the width of the first gap (G3, G4, G5) and the second gap (G6, G7, G8) are calculated using to the blanket calibration value, and the respective sheet calibration values for the sheets of the particular print job. The gap setpoint profile correspondingly may comprise matching first portions (100, 100A, 100B) and second portions (101, 101A, 101B).

Figure 8:
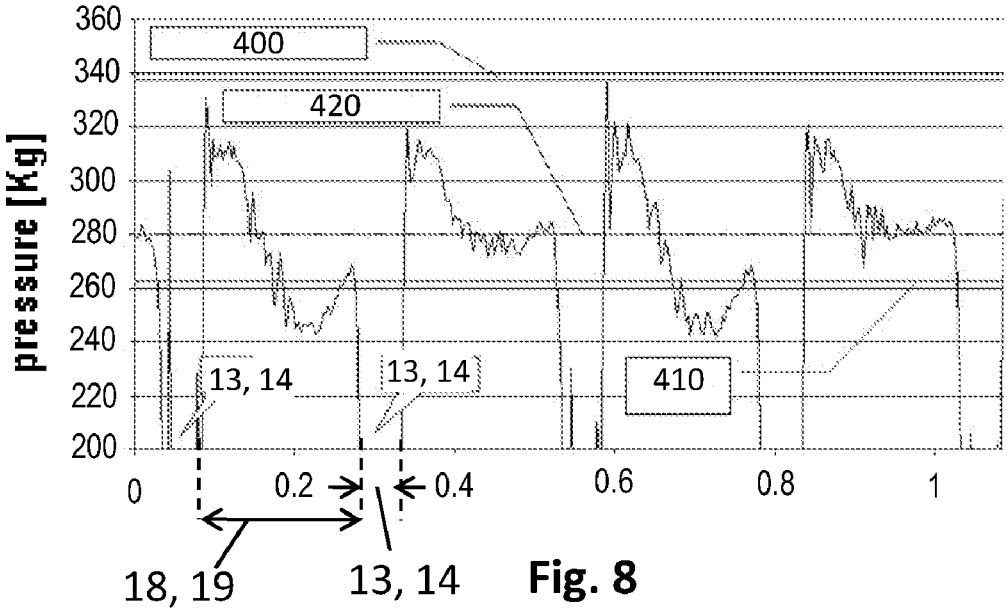
FIG. 8 a plot of a measured nip pressure in a system wherein the gap is adjusted when a seam area passes through the nip and wherein the gap is maintained at a constant when a non-seam area passes through the nip according to the principles described herein.
Figure 9:
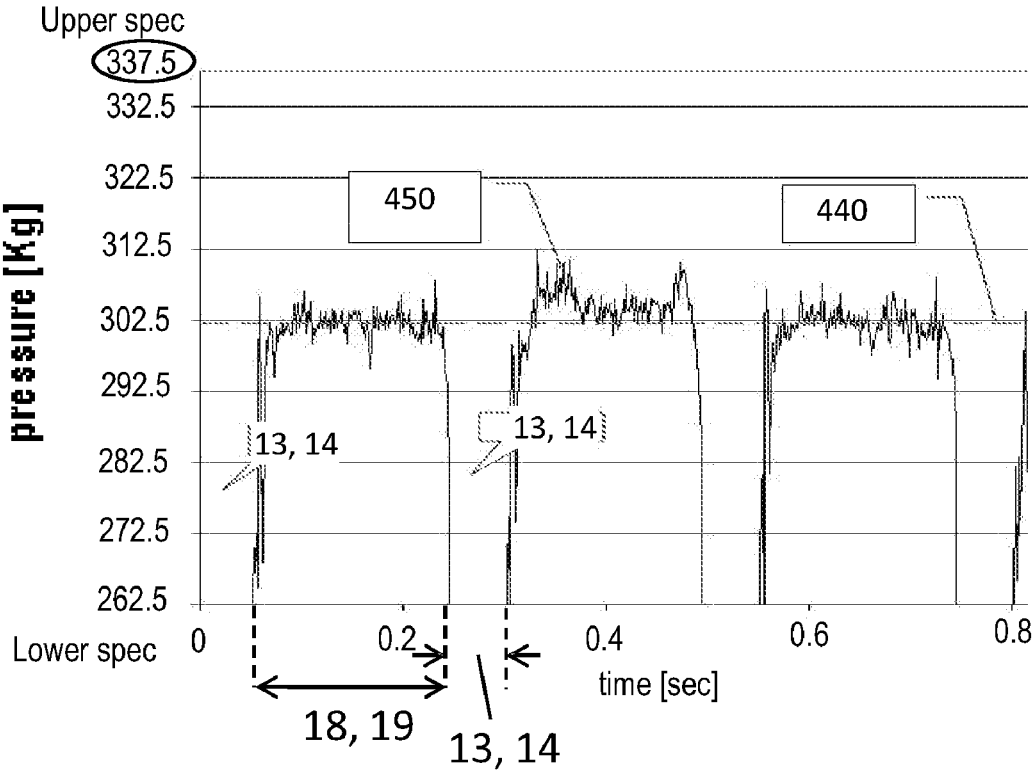
FIG. 9 is a plot of a measured nip pressure wherein the gap is adjusted when a seam area passes through the nip similar to FIG. 8, while current regulation is applied when the non-seam area passes through the nip, unlike FIG. 8 and according to the principles described herein.

FIGS. 8 and 9 show graphs that plot a measured nip force, in kilograms, on a vertical axis, against time in seconds, on a horizontal axis. As the nip force is representative for, and directly correlates to, the nip pressure, the skilled person will understand that the nip force is indicative for the nip pressure in FIGS. 8 and 9. FIG. 8 shows an example of a plot of a measured nip force (or pressure) in a system wherein the gap (G) is adjusted according to a gap setpoint profile when the seam area (13, 14) passes through the nip (6). No current regulation is applied when the non-seam area (18, 19) passes through the nip (6). However, the gap (G) is kept at a constant when the non-seam area (18, 19) passes through the nip (6). FIG. 8 is illustrated to show the advantages of using current regulation, which is shown in FIG. 9. As a consequence of maintaining a constant gap (G) and not using current regulation in the non-seam areas (18, 19), the nip force (or pressure) varies significantly at the non-seam areas (18, 19), as can be seen from FIG. 8. In the shown example the nip force in the non-seam area (18, 19) varies between approximately 240 kilograms, as indicated by line 400, and 340 kilograms, as indicated by line 410, around a nominal force of approximately 300 kilograms, resulting in a change of 100 kilograms or approximately 33% of the nominal force (420). Correspondingly, the nip pressure variations are approximately 33% of the nominal pressure. In an example comprising a print system, such variations may lead to reduced print quality at the beginning of a printed image, for example band at the beginning of the image and differences between the beginning and the end of the image. Also blanket life may be reduced.

FIG. 9 shows a plot of a measured nip force, wherein the gap (G) was adjusted when a seam area (13, 14) passes through the nip (6), as in FIG. 8. Unlike FIG. 8, current regulation is applied when the non-seam area (18, 19) passes through the nip (6). Also a gain scheduling algorithm is applied to switch between the gap setpoint profile in the seam area (13, 14) and the current regulation in the non-seam area (18, 19). When the end of the seam area (18, 19) passes through the nip (6), the drum may be set at an initial gap (G), and drive current regulation may be switched on. The measured nip force at the non-seam area (18, 19) is more constant than in FIG. 8. Correspondingly, the nip pressure is more constant than in FIG. 8.

In the shown example of FIG. 9, the nip force (450) varies between approximately 292 and approximately 312.5 kilograms, which is a difference of 20.5 kilograms or approximately 6.7% of the nominal nip force (440). Correspondingly, the nip pressure has variations of approximately 6.7% of the nominal nip pressure. Therefore, the nip pressure is better maintained in FIG. 9 than in FIG. 8 which may be attributed to the use of the drive current regulation and/or the drive current regulation combined with gain scheduling. In an example of the system (1), the nip pressure (450) may be maintained within a range of approximately 12.5% or less, or 10% or less, or 7.5% or less, or 5% or less, of the nominal nip pressure (440), when the non-seam areas (18, 19) of the impression drum (4) and/or the transfer drum (3) pass through the nip (6). The gain scheduling algorithm contributes in smoothening the transition between position control and drive current regulation, contributing in maintaining a relatively constant nip pressure.

Figure 10:
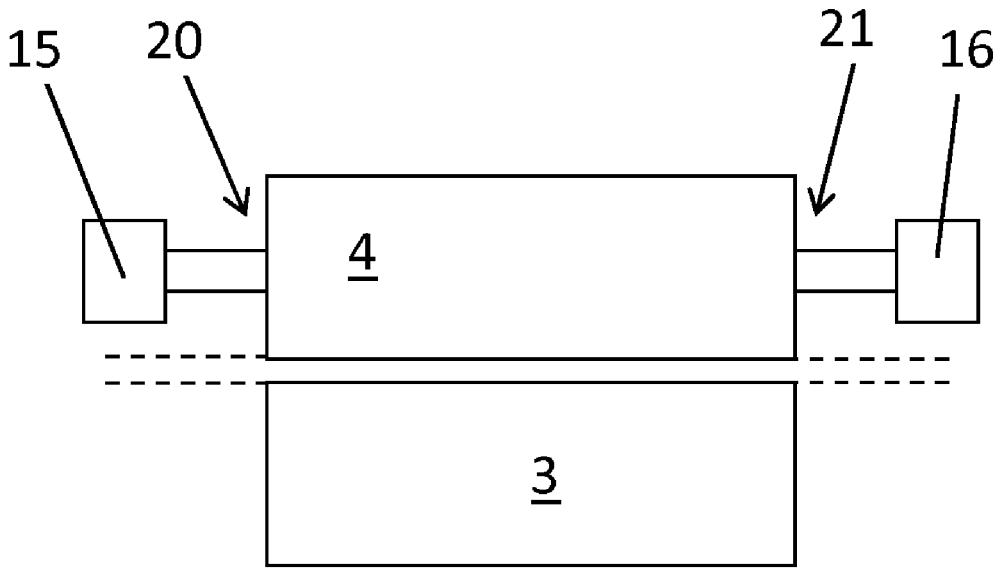
FIG. 10 is a diagram of an example of a portion of the sheet processing system wherein two drums are parallel according to one example of the principles described herein.
Figure 11:
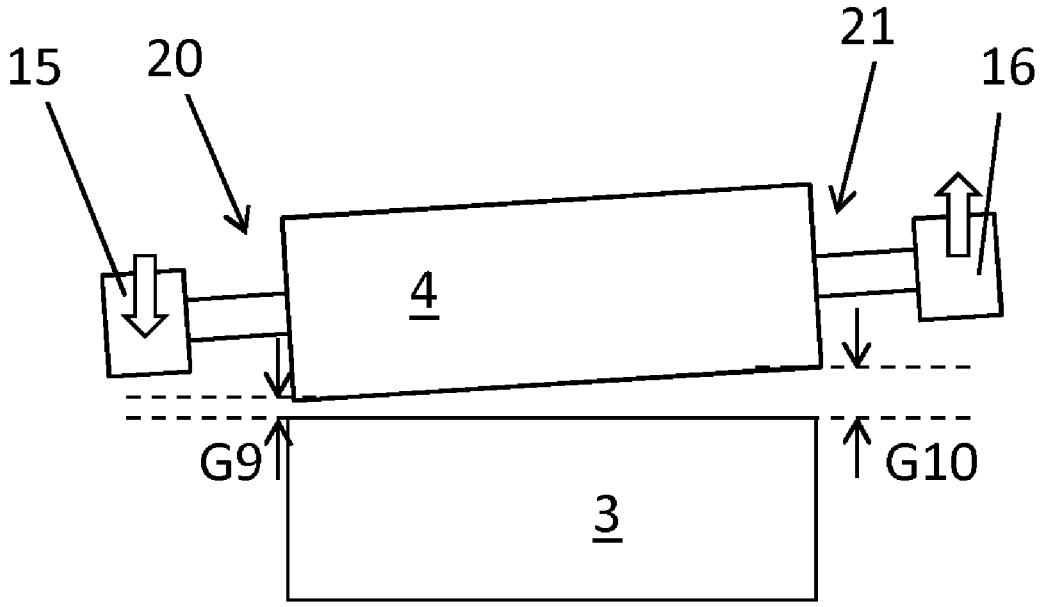
FIG. 11 is a diagram of the example of FIG. 10 wherein one drum is inclined with respect to the opposite drum according to one example of the principles described herein.

FIGS. 10 and 11 illustrate the same example in different orientations. FIGS. 10 and 11 schematically depict a parallel and a non-parallel displacement of the drum (4) with respect to the opposite drum (3), respectively. As shown, one actuator (15) is provided at one end (20) of the impression drum (4), and a second actuator (16) is provided at an opposite end (21). The actuators (15, 16) may be similar or equal. The actuators (15, 16) may be similar to the actuator shown with reference to FIG. 5. Since the surfaces of the drums (3, 4) may have non-parallel irregularities or other irregularities such as blanket thickness non-uniformity, different current readings may be received from the actuators (15, 16). The manager (50) may correct accordingly, sending different instructions to each actuator (15, 16), inducing non-parallel movement.

As shown by the example of FIG. 11, the actuators (15, 16) are not located at the exact respective ends (20, 21). Therefore, a displacement actuated by an actuator (15) at one end (20) incurs a displacement of the drum (4) at the opposite end (21). For example, the gap (G9) near the first end (20) may increase when the gap (G10) near the opposite end (21) is increased. The manager (50) may compensate for a displacement of the gap (G9) near one end (20) of the drum (4) due to a displacement of an actuator (16) at the opposite end (21) of the drum (4).

Figure 12:
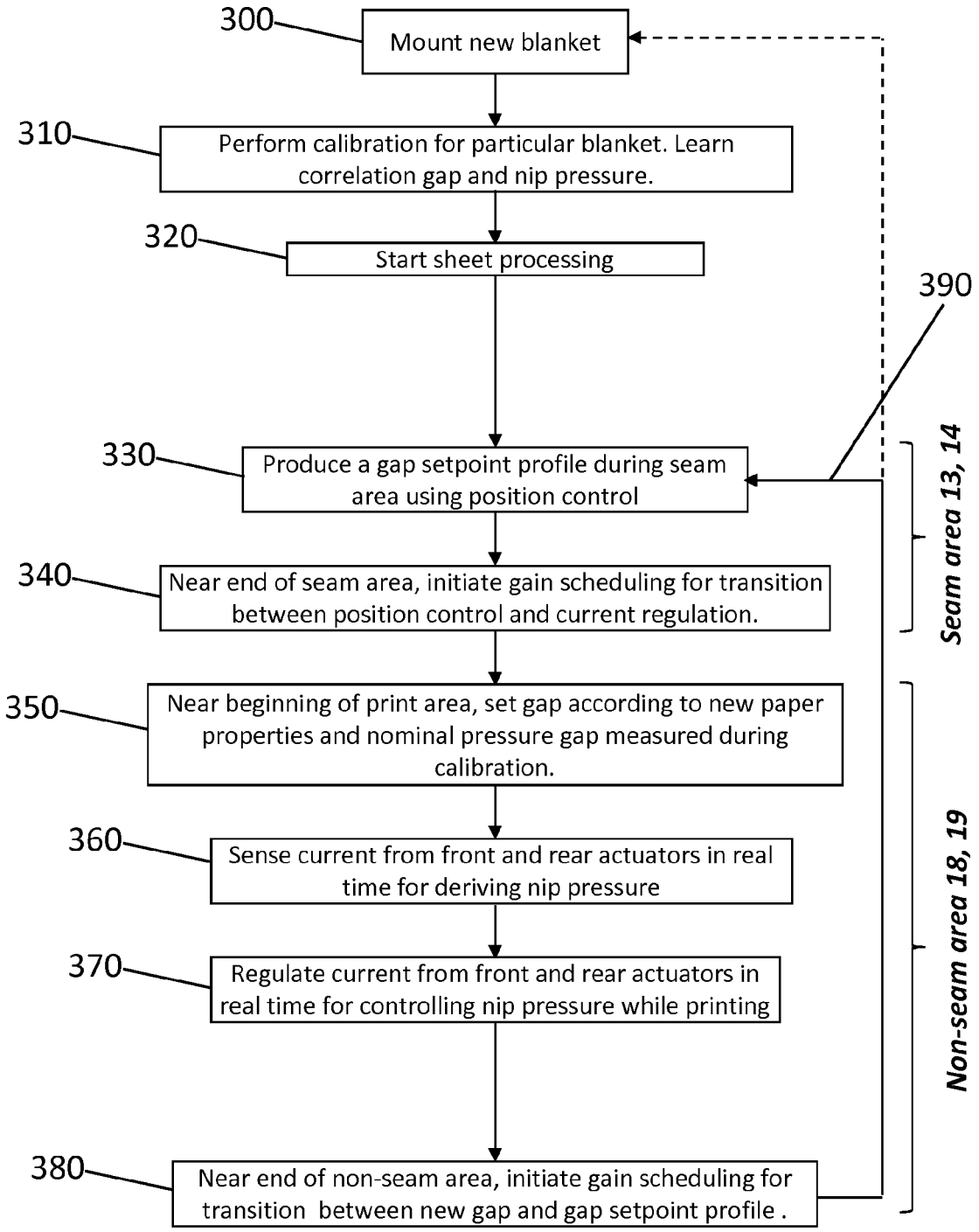
FIG. 12 is a flowchart showing an illustrative method of processing sheets according to one example of principles described herein.

FIG. 12 illustrates a flowchart of an example of a method of processing sheets. The method starts with a new blanket (5) being mounted (300) on the transfer drum (3). The system is then calibrated (310) for the new blanket (5). A calibration value (62) may be calculated and stored in the manager (50), in a second step (310). The calibration value (62) may comprise a blanket calibration value (63). The calibration value (62) may comprise a correlation between the initial gap (G) and the nip pressure for the respective blanket (5).

The sheet processing then starts (320). Here, the calibration values (62) may comprise at least one sheet calibration value (64) corresponding to at least one sheet property pertaining to the particular job. The calibration values (62) may be used to calculate each gap profile setpoint used in the next step (330). The end position of the gap setpoint profile may be an initial gap (G6, G7, G8).

In the example shown in FIG. 12, the sheet processing starts when the seam area (13, 14) passes through the nip (6). Therefore, the position control is applied (330). The gap setpoint profile is used to adjust the gap (G) at the seam area (13, 14) while the seam area (13, 14) passes through the nip (6). By adjusting the gap (G), pressure variations that would otherwise occur as a result of the seam area (13) can be smoothened. The end position of the gap setpoint profile may be an initial gap (G6, G7, G8).

Then, the gain scheduling is applied (340) to smoothen the transition between the position control and current regulation. The initial gap (G6, G7, G8) is then set (350) for the non-seam area (18, 19) and the non-seam area (18, 19) passes through the nip (6).

The current of each actuator (15, 16) is then measured (360) for deriving the nip pressure. The current of the actuators (15, 16) is then regulated (370) in real time for maintaining the nip pressure near a constant nip pressure. The current may be continuously corrected to prevent that large changes in the actuator current occur. In one example, the current of both the front and rear actuators (15, 16) is regulated, for parallel and/or non-parallel displacement of the impression drum (4) with respect to the opposite drum (3). The current of the opposite actuators (15, 16) are regulated with respect to each other to correct a gap change near one end (20) of the drum (4) due to a displacement of the opposite actuator (16) at the opposite end (21) of the drum (4), as explained with reference to FIG. 11.

A gain scheduling algorithm is then again applied (380) for smooth switching between the current regulation and gap adjustment, approximately when the beginning of the seam area (13, 14) and the end of the non-seam area (18, 19) pass through the nip (6). Thereafter, the process may reinitiate as indicated by arrow 390 at the fourth step (330).

In blocks 330-340, a second sheet having a second property different from a first property of the first sheet may be processed. In block 350, at the end of the gap setpoint profile, a second gap (G) may be set according to the second sheet property. The second initial gap (G6, G7, G8) may be different from the first initial gap (G3, G4, G5).

In an example, the seam area (13, 14) passes through the nip (6) while the gap setpoint profile is produced (330). Block 330 relates to position control. In an example, the position control is triggered when the seam area (19) of the impression drum (4) passes through the nip (6). Then, gain scheduling is applied in the fifth step (340). The non-seam area (18, 19)

passes through the nip (6) at blocks 350-380. In an example, a sheet is printed during the blocks 350-370.

The preceding description has been presented only to illustrate and describe examples of the principles described. This description is not intended to be exhaustive or to limit these principles to any precise form disclosed. Therefore, Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit. Many modifications and variations are possible in light of the above teaching.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

What is claimed is:

1. A sheet processing system, comprising:

a number of drums for processing sheets, one of the drums comprising a seam area and a non-seam area, a gap between the drums, an actuator for displacing one of the drums for setting the gap, a manager, comprising a memory and a processor, that:

regulates the actuator current when the non-seam area passes through a nip so as to maintain a nip pressure, and signals the actuator to adjust the gap according to a predetermined gap setpoint profile when the seam area passes through the nip.

2. The system of claim 1, comprising:

a nip pressure controller that regulates the actuator current when the non-seam area passes through the nip to maintain the nip pressure, and a position controller arranged to signal the actuator to adjust the gap when the seam area passes through the nip, according to a predetermined gap setpoint profile, in which the manager instructs the nip pressure controller and the position controller.

3. The system of claim 1, in which the manager further comprises a gain scheduling algorithm for smooth switching between nip pressure controller and position control.

4. The system of claim 1, wherein the gap setpoint profile comprises:

a first portion corresponding to a first gap for a first sheet having first sheet properties, a seam portion for increasing the gap at the seam area, and a second portion corresponding to a second gap, different from the first gap, for a second sheet having second sheet properties, different from the first sheet properties.

5. The system of claim 1, further comprising:

a first actuator at a first end of the drum, a second actuator at an opposite end of the drum, in which the actuators are arranged to set the drums in both a parallel and a non-parallel position with respect to each other, and in which the manager regulates the current of the first actuator to compensate for a displacement of the second actuator.

6. The system of claim 1, in which the manager further comprises a calibration value comprising a correlation between an actuator current and a gap width, the calibration value corresponding to a particular blanket, sheet or combinations thereof.

7. The system of claim 1, in which the system is incorporated into an electrophotographic printer, and:

in which the drums comprise an impression drum and a transfer drum, in which one of the drums comprises the seam and non-seam area, and in which the seam area comprises a gripper arrangement.

8. A method of processing sheets, comprising:

setting an initial gap between a number of drums with a number of actuators, in which a number of the drums comprises a seam area and a non-seam area, and in which the initial gap corresponds to a first sheet property, advancing a first sheet having said first sheet property through a nip, maintaining a nip pressure when the non-seam area passes through the nip by regulating a current of the actuators, and adjusting the gap according to a predetermined gap setpoint profile when the seam area passes through the nip, in which a nip pressure controller regulates the actuator current when the non-seam area passes through the nip to maintain the nip pressure, and in which a position controller signals the actuator to adjust the gap when the seam area passes through the nip, according to the predetermined gap setpoint profile.

9. The method of claim 8, further comprising:

mounting a new blanket on a number of the drums, calculating a blanket calibration value comprising a correlation between a gap and an actuator current reading for the blanket, and using the blanket calibration value for regulating the drive current according to the gap setpoint profile.

10. The method of claim 8, further comprising:

processing a second sheet after having processed the first sheet, and setting a second initial gap different from the first initial gap corresponding to a second sheet property different from the first sheet property.

11. The method of claim 8, further comprising applying a gain scheduling algorithm for a relatively smooth switching between actuator current regulation and gap adjustment near the beginning of the seam area, near the end of the seam area, or combinations thereof.

12. The method of claim 8, further comprising:

displacing a first actuator at a first end of the drum so that the drum is inclined with respect to the opposite drum, and regulating the current of an actuator at an opposite end of the drum to correct a displacement of the drum near opposite first end due to the displacement of the first actuator.

13. The method of claim 8, in which the pressure differences in the nip along the non-seam area do not exceed approximately 7.5 percent of the nominal nip pressure along the non-seam area.

14. The method of claim 8, in which the method is performed on an electrophotographic printer.

* * * * *